US010938129B2

(12) United States Patent
Belisle

(10) Patent No.: US 10,938,129 B2
(45) Date of Patent: Mar. 2, 2021

(54) HIGH AMPERAGE COMPONENT ELECTRICAL MECHANICAL INSTALLATION

(71) Applicant: Hamilton Sundstrand Corporation, Charlotte, NC (US)

(72) Inventor: Francis C. Belisle, Roscoe, IL (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 16/238,799

(22) Filed: Jan. 3, 2019

(65) Prior Publication Data

US 2020/0220282 A1 Jul. 9, 2020

(51) Int. Cl.
*H01R 9/24* (2006.01)

(52) U.S. Cl.
CPC ..... *H01R 9/2416* (2013.01); *H01R 2201/26* (2013.01)

(58) Field of Classification Search
CPC ..... H01R 9/2416; H01R 25/16; H01R 25/14; H01R 25/162; H01R 2201/26; H02G 5/007
USPC ..... 439/212, 213
See application file for complete search history.

(56) References Cited

U.S. PATENT DOCUMENTS 1,807,852 A * 6/1931 MacGahan ..... G01R 1/203 324/126
4,205,892 A * 6/1980 Clement ..... H02B 1/056 361/652
4,559,413 A * 12/1985 Logstrup ..... B60M 1/307 174/149 B
5,011,421 A * 4/1991 Duke ..... H02G 5/06 174/71 B
5,791,932 A 8/1998 Hasenfratz
6,709,274 B2 3/2004 Lazaro, Jr. et al.
2011/0124240 A1* 5/2011 Savant ..... H01R 4/30 439/722
2014/0225593 A1* 8/2014 Nakajima ..... G01R 15/20 324/117 R (Continued)

FOREIGN PATENT DOCUMENTS

EP 3061112 A1 8/2016
EP 3086352 A1 10/2016

(Continued)

OTHER PUBLICATIONS

European Search Report for Application No. 19208673.4, dated Apr. 28, 2020, 9 pages.

*Primary Examiner* — Hien D Vu
(74) *Attorney, Agent, or Firm* — Cantor Colburn LLP

(57) ABSTRACT

An electrical assembly includes a first conductor, a second conductor, and a bus bar. The first conductor is disposed on a terminal block and defines a first conductor opening. The second conductor is spaced apart from the first conductor. The bus bar extends from an electrical component. The bus bar has a first bus bar surface that is arranged to engage the first conductor and a second bus bar surface that is disposed opposite the first bus bar surface. The second bus bar surface is arranged to engage the second conductor. Each of the first bus bar surface and the second bus bar surface extends between an end surface of the bus bar and the electrical component.

7 Claims, 2 Drawing Sheets

(56) References Cited

U.S. PATENT DOCUMENTS

| | | | | |
|---|---|---|---|---|
| 2015/0103454 | A1* | 4/2015 | Schripsema ..... | H02H 3/087<br>361/63 |
| 2015/0194801 | A1* | 7/2015 | Schripsema ..... | H02H 3/18<br>361/84 |

FOREIGN PATENT DOCUMENTS

| | | | |
|---|---|---|---|
| EP | 3361489 | A1 | 8/2018 |
| WO | 2013025175 | A1 | 2/2013 |

* cited by examiner

HIGH AMPERAGE COMPONENT ELECTRICAL MECHANICAL INSTALLATION

BACKGROUND

Exemplary embodiments pertain to the art of electrical assemblies for high amperage electrical mechanical installations.

The present standard for electrical connections of high amperage components such as relays or contactors or solid state power devices or power sources or power using equipment, is to have the electrical main power connections provided by threaded bolts or terminal studs that clamp the component to a conductor. However, due to increasing electrical power levels in excess of 1000 Amperes, a bolted joint (single or double bolt or stud) with a single electrical interface surface may provide insufficient voltage clamping area or mechanical support of the conductors.

BRIEF DESCRIPTION

Disclosed is an electrical assembly for an aircraft power distribution system that includes a terminal block, a first conductor, and a second conductor. The terminal block defines a terminal block opening. The first conductor is disposed on the terminal block and defines a first conductor opening. The second conductor is spaced apart from the first conductor. The second conductor has a first fastener that extends through the second conductor, the first conductor opening, and into the terminal block opening. A gap is defined between the first conductor and the second conductor.

Also disclosed is an electrical assembly that includes a first conductor, a second conductor, and a bus bar. The first conductor is disposed on a terminal block and defines a first conductor opening. The second conductor is spaced apart from the first conductor. The bus bar extends from an electrical component. The bus bar has a first bus bar surface that is arranged to engage the first conductor and a second bus bar surface that is disposed opposite the first bus bar surface. The second bus bar surface is arranged to engage the second conductor. Each of the first bus bar surface and the second bus bar surface extends between an end surface of the bus bar and the electrical component.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Advancements in aircraft power distribution systems have required the use of high amperage components that must be capable of withstanding harsh environments. High amperage components may be components that may be applied to applications of at least 500 Amperes. The harsh environments may be those in which high vibrations, high temperatures, potential contamination, or low atmospheric pressures may be experienced by the components.

Figures 1A, 1B:
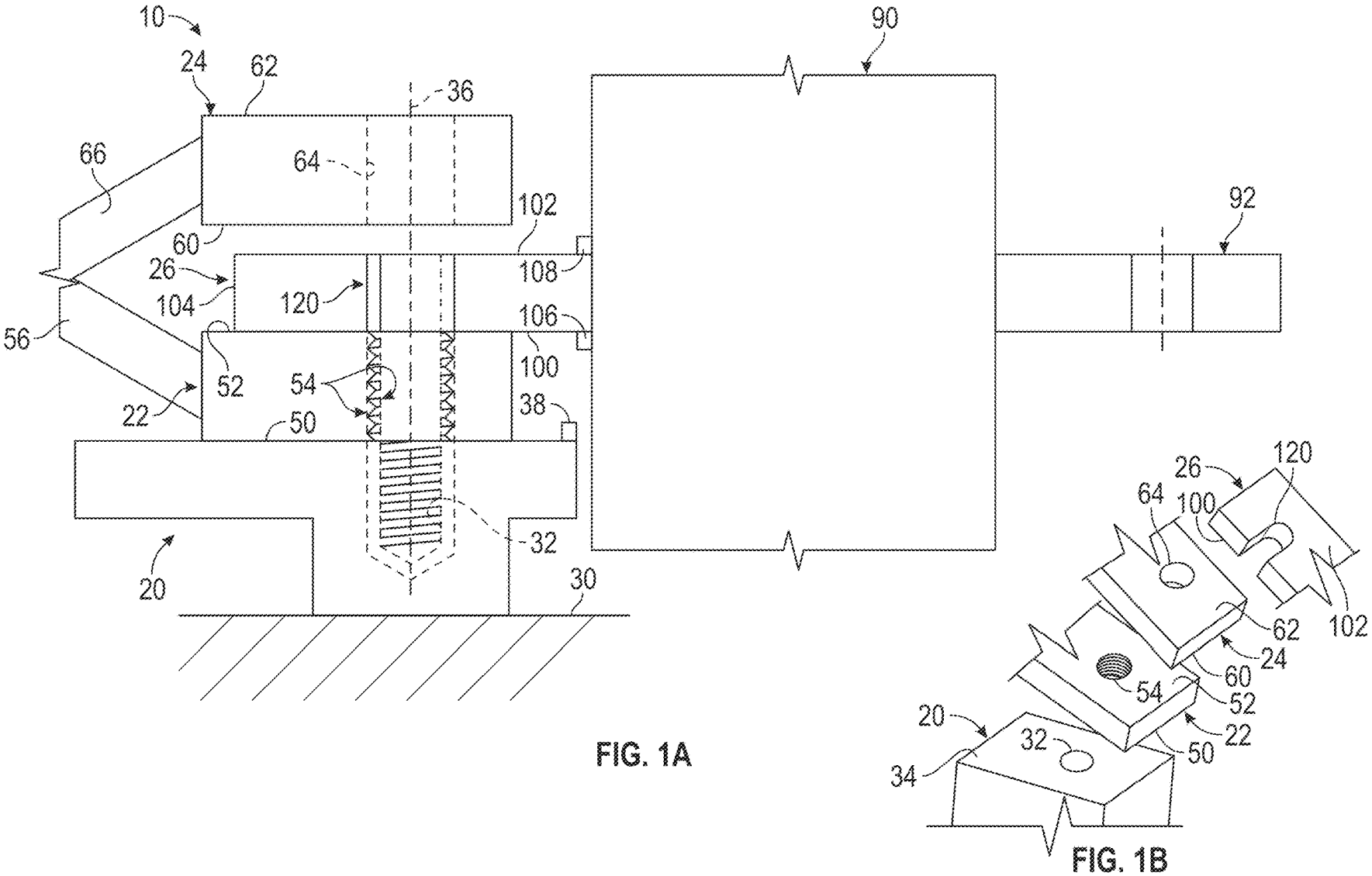
FIG. 1A is a partial schematic view of an electrical assembly having dual side electrical interfaces.
FIG. 1B is a disassembled view of the electrical assembly.

Referring to FIGS. 1A-4, an electrical assembly 10 that may be applied to high amperage components and capable of performance within harsh environments is illustrated. The electrical assembly 10 employs electrical and mechanical connections having dual side electrical interfaces using captive mechanical connections that provide both a high electrical amperage carrying connection and robust mechanical mounting of the electrical component. Referring to FIGS. 1A and 1B, the electrical assembly 10 includes a mounting terminal block 20, a first conductor 22, a second conductor 24, and a component electrical bus bar 26.

The terminal block 20 may be secured to a surface 30, such as a surface of a heat sink, a surface of a mounting block, or a portion of a vehicle such as an aircraft. The terminal block 20 may at least partially define a mounting base for the conductors 22, 24, and an electrical component. The terminal block 20 may be made of a thermally conductive, dielectric material. The terminal block 20 may act as an insulator that protects the electrical assembly 10 from foreign object damage fault from below or along the conductors 22, 24, may prevent corona initiation to the surface 30, may protect against creepage (surface) arc faults, may protect against contamination or environment pollutants, or may be configured for aircraft feeder design or integrated bus bar power distribution panel applications.

The terminal block 20 defines a terminal block opening 32 that extends from a mounting surface 34 of the terminal block 20 towards the surface 30 along an axis 36. The terminal block opening 32 may be a blind hole, a threaded hole, or may include a helical insert locking thread, as shown in FIG. 1A. The terminal block opening 32 enables the use of captive fasteners that avoid foreign object debris, improves assembly ease as well as improves on vehicle maintainability. The terminal black opening 32 may be a clearance hole, as shown in FIG. 1B, while the opening of the first conductor 54 is a threaded hole. The terminal block 20 may also define a locating tab 38 that is located proximate an end of the terminal block 20. The locating tab 38 extends from the mounting surface 34 and is spaced apart from the terminal block opening 32.

The first conductor 22 is arranged to be disposed on the terminal block 20. The first conductor 22 includes a first conductor first surface 50 and a first conductor second surface 52 that is disposed opposite the first conductor first surface 50. The first conductor first surface 50 is arranged to engage the mounting surface 34 of the terminal block 20. The first conductor second surface 52 is arranged to engage the bus bar 26 at surface 100. The first conductor 22 defines a first conductor opening 54 (for the fastener(s)) that extends from the first conductor second surface 52 towards the first conductor first surface 50 along the axis 36. The first conductor opening 54 is arranged to be disposed coaxial with the terminal block opening 32 along the axis 36. The first conductor opening 54 may be a clearance hole, as shown in FIG. 1A, or a threaded hole, as shown in FIG. 1B. The first conductor opening 54 and the terminal block opening 32 may both be threaded holes.

The first conductor 22 includes a first electrical lead 56 that extends from an end of the first conductor 22. The first electrical lead 56 is disposed between and is spaced apart from the first conductor first surface 50 and the first conductor second surface 52.

The second conductor 24 is spaced apart from the first conductor 22. The second conductor 24 includes a second conductor first surface 60 and a second conductor second surface 62 that is disposed opposite the second conductor first surface 60. The second conductor first surface 60 is arranged to engage the bus bar 26 at surface 102. The second conductor second surface 62 is arranged to be spaced apart from and not engage the bus bar 26. The second conductor 24 defines a second conductor opening 64 that extends from the second conductor second surface 62 towards the second conductor first surface 60 along the axis 36. The second conductor opening 64 is arranged to be disposed coaxial with the first conductor opening 54 and the terminal block opening 32 along the axis 36. The second conductor opening 64 is a clearance hole.

The second conductor 24 includes a second electrical lead 66 that extends from an end of the second conductor 24. The second electrical lead 66 is disposed between and is spaced apart from the second conductor first surface 60 and the second conductor second surface 62. The first electrical lead 56 and the second electrical lead 66 are electrically common (same electrical voltage potential).

Referring to FIGS. 2A, 2B, 3A, and 3B, a first fastener 70 extends through the second conductor opening 64, through the first conductor opening 54, and extends into the terminal block opening 32. The first fastener 70 includes a washer or a first fastener head integral washer flange 72 that is arranged to engage the second conductor second surface 62. The first fastener 70 may be provided with the second conductor 24, such that the first fastener 70 is integral with the second conductor 24. The first fastener 70 may be a separately provided component that extends through the second conductor 24, extends through the first conductor 22, and extends into the terminal block 20.

Figure 2A:
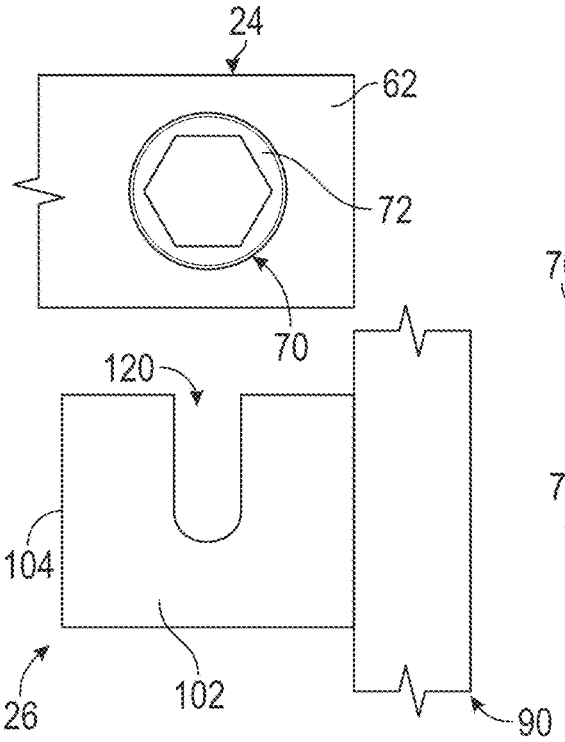
FIG. 2A is a view of a bus bar and a conductor of the electrical assembly in an uninstalled condition.
Figure 2B:
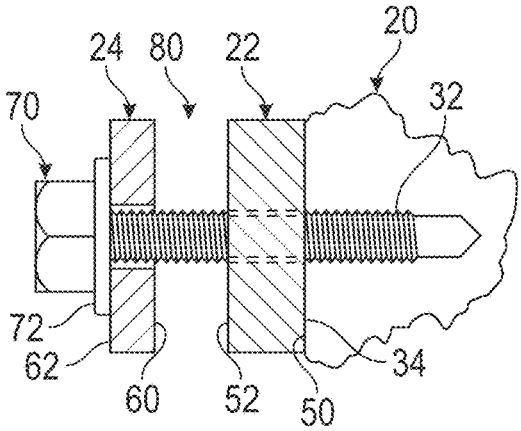
FIG. 2B is a partial cross-sectional view of the conductor partially assembled with a terminal block of the electrical assembly.

Referring to FIG. 2B, the spacing apart of the first conductor 22 from the second conductor 24 defines a gap 80. The gap 80 is defined between the second conductor first surface 60 and the first conductor second surface 52. The bus bar 26 is arranged to extend into the gap 80 such that the first fastener 70 secures the first conductor 22 and the second conductor 24 to the bus bar 26. The combination of the first conductor 22, the second conductor 24, and the bus bar 26 define a terminal that is rated for at least 500 Amperes. The gap 80 in FIG. 2B is used to position and slide the component bus bar (component conductor) 26 into the dual surface electrical joint 100 and 102.

Figure 3A:
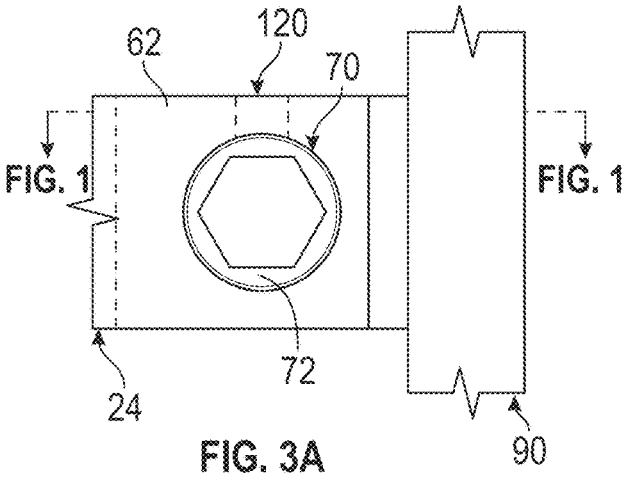
FIG. 3A is a partial cross-sectional view of the bus bar and the conductor of the electrical assembly of FIG. 1A in an installed condition.
Figure 3B:
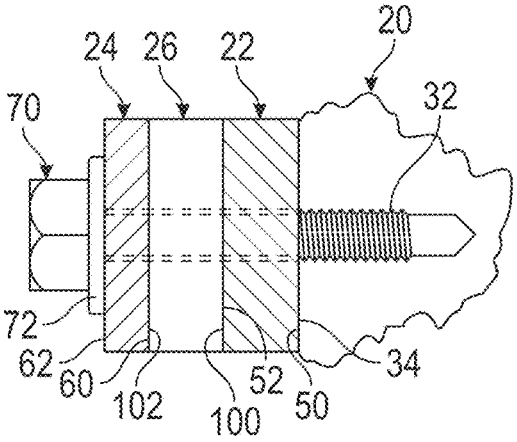
FIG. 3B is a partial cross-sectional view of the conductor assembled with the bus bar of the electrical assembly.

Referring to FIGS. 1A, 2A, and 3A, the bus bar 26 extends from a first side of an electrical component 90 and a second bus bar 92 extends from a second side of the electrical component 90 that is disposed opposite the first side. The bus bar 26 and the second bus bar 92 each provide double-sided electrical conductor interfaces for the electrical component 90 that increases the current or voltage carrying capability of the electrical component 90. The electrical component 90 is at least one of a relay, a contactor, a solid state switch, or similar electrical component interface.

The bus bar 26 extends from the first side of the electrical component 90 and extends into the gap 80. The bus bar 26 includes a first bus bar surface 100, a second bus bar surface 102, and a bus bar end surface 104. The first bus bar surface 100 is arranged to engage the first conductor second surface 52 of the first conductor 22. The second bus bar surface 102 is disposed opposite the first bus bar surface 100 and is arranged to engage the second conductor first surface 60 of the second conductor 24. Each of the first bus bar surface 100 and the second bus bar surface 102 extend between the bus bar end surface 104 and the first side of the electrical component 90.

The bus bar 26 includes a pair of locating tabs 106, 108, wherein the first locating tab 106 extends from the first bus bar surface 100 and the second locating tab 108 extends from the second bus bar surface 102. The pair of locating tabs 106, 108 are disposed proximate the first side of the electrical component 90. The first locating tab 106 is arranged to be disposed proximate or engage the locating tab 38 of the terminal block 20.

The bus bar 26 defines a first notch 120 that extends through the first bus bar surface 100 and the second bus bar surface 102 along the axis 36. The first notch 120 extends at least partially across the bus bar 26 and is disposed between the bus bar end surface 104 and the electrical component 90.

The first notch 120 enables the bus bar 26 to be slidably disposed between the first conductor 22 and the second conductor 24 such that the first fastener 70 is arranged to extend through or is at least partially received within the second conductor opening 64, the first notch 120, the first conductor opening 54, and extends into the terminal block opening 32 to couple the first conductor 22 to a conductor interface of the bus bar 26 and to couple the second conductor 24 to a conductor interface of the bus bar 26.

Figure 4:
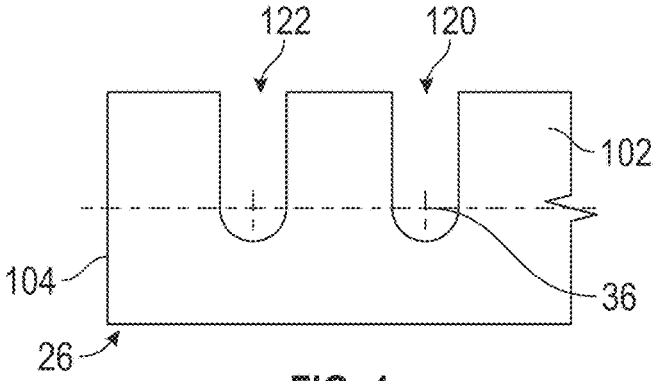
FIG. 4 is a view of a bus bar that may be provided with the electrical assembly.

Referring to FIG. 4, the bus bar 26 may define a second notch 122 that is spaced apart from the first notch 120. The second notch 122 extends through the first bus bar surface 100 and the second bus bar surface 102 along an axis that is disposed parallel to the axis 36. The second notch 122 extends at least partially across the bus bar 26 and is disposed between the bus bar end surface 104 and the electrical component 90. A second fastener may extend through the second conductor 24, the second notch 122, the first conductor 22, and into the terminal block 20.

The combination of the first notch 120 and the second notch 122 enables the bus bar 26 to be slidably disposed between the first conductor 22 and the second conductor 24 such that the first fastener 70 and the second fastener are arranged to extend through or at least partially received within respective openings of the second conductor 24, the first notch 120 and the second notch 122, respectively, respective openings of the first conductor 22, and respective openings of the terminal block 20 to couple the first conductor 22 and the second conductor 24 to opposite sides of the bus bar 26. The double fastener approach provides multiple bolted interfaces for mechanical support of heavy components or heavy electrical conductor interfaces against high dynamic loads as well as allows for a larger clamp area of the electrical conductors.

The clamping of the first conductor 22 to the first bus bar surface 100 and the clamping of the second conductor 24 to the second bus bar surface 102 provides double-sided electrical mechanical mounting and connection of the electrical component 90. The double-sided electrical mechanical mounting and connection utilizes more surface area to increase the electrical surface area, improving the capabilities of the electrical assembly 10 such that the electrical assembly 10 may be employed with power distribution systems operating at 500 Amperes or greater. The double-sided electrical mechanical mounting improves the durability of the electrical assembly 10 against vibration dynamic loads with large electrical conductors or heavy electrical components.

The double-sided electrical mechanical mounting and connection allows the first conductor 22 to have a greater cross-sectional thickness as compared to the second conductor 24 or allows a feedthrough terminal and a top conductor for added electrical and heat conduction area. Additionally, the notch provided in the bus bar enables the electrical component 90 having the bus bar 26 to have a slide in installation that does not require the removal of any threaded fasteners to install or remove the electrical component 90 having the bus bar 26 from the electrical assembly 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An electrical assembly for an aircraft power distribution system, comprising:

a terminal block defining a terminal block opening;

a first conductor disposed on the terminal block, the first conductor defining a first conductor opening;

a second conductor spaced apart from the first conductor, the second conductor defining a second conductor opening;

a bus bar extending from an electrical component disposed between the first and second conductors; and a first fastener that extends through the second conductor, the first conductor opening, and into the terminal block opening;

wherein the first conductor opening is a threaded hole.

2. The electrical assembly claim 1, the bus bar is arranged to be slidably disposed between the first conductor and the second conductor, such that the first fastener is received within the first notch.

3. The electrical assembly of claim 1, the electrical component is at least one of a relay, a contactor, or a solid state switch or similar electrical component interface.

4. The electrical assembly of claim 3, the first fastener extends into the first notch to couple the bus bar to the first conductor and the second conductor.

5. The electrical assembly of claim 1, the first conductor is arranged to engage the first bus bar surface.

6. The electrical assembly of claim 5, the second conductor is arranged to engage the second bus bar surface.

7. The electrical assembly of claim 1, the first conductor and the second conductor are rated for at least 500 Amperes.

* * * * *